US006380683B1

(12) United States Patent
Kahn

(10) Patent No.: US 6,380,683 B1
(45) Date of Patent: Apr. 30, 2002

(54) SOCKET AND LIGHT BULB ASSEMBLY UTILIZING MAGNETIC COUPLING

(76) Inventor: Henry Kahn, P.O. Box 444, Flourtown, PA (US) 19031

( * ) Notice: Subject to any disclaimer, the term of this patent is extended or adjusted under 35 U.S.C. 154(b) by 0 days.

(21) Appl. No.: 09/735,052

(22) Filed: Dec. 13, 2000

(51) Int. Cl.[7] ..... H01J 7/44

(52) U.S. Cl. ..... 315/56; 362/95; 439/38; 439/638

(58) Field of Search ..... 315/56; 362/95, 362/378; 439/38, 39, 252, 375, 638, 660, 668

(56) References Cited

U.S. PATENT DOCUMENTS 4,156,265 A * 5/1979 Rose ..... 361/179
5,016,145 A * 5/1991 Singleton ..... 362/223
5,758,959 A * 6/1998 Sieczkowski ..... 362/365

* cited by examiner

*Primary Examiner*—David H. Vu
*Assistant Examiner*—Thuy Vinh Tran
(74) *Attorney, Agent, or Firm*—Goldstein Law Offices, P.C.

(57) ABSTRACT

A socket and light bulb assembly utilizing magnetic coupling including a socket portion having a generally cylindrical configuration. The socket portion has a first end and a second end. The first end has a recess extending inwardly thereof. The recess is defined by a smooth interior surface. The recess has a magnetic disk disposed at a bottom thereof. The socket portion has a contact disposed thereon. The socket portion includes wiring in communication with the contact for being coupled with an electrical source. A light bulb portion is provided that is adapted for coupling with the socket portion. The light bulb portion includes an upper light portion and a lower stem portion. The lower stem portion is dimensioned for being received within the recess of the socket portion. The lower stem portion is defined by a smooth exterior surface. The lower stem portion has a contact disposed therein whereby the contact of the socket portion connects with the contact of the light bulb portion to complete a circuit.

6 Claims, 3 Drawing Sheets

SOCKET AND LIGHT BULB ASSEMBLY UTILIZING MAGNETIC COUPLING

BACKGROUND OF THE INVENTION

The present invention relates to a socket and light bulb assembly utilizing magnetic coupling and more particularly pertains to simplifying the replacement of light bulbs by eliminating the need to rotate the light bulb in order to remove it from the socket.

Standard light bulbs and respective sockets utilize a threaded coupling in order to secure the light bulb within the socket. This typically involves a person rotating the light bulb a number of revolutions in order to remove or place the light bulb with respect to the socket. This sometimes presents a problem when attempting to replace light bulbs in difficult to reach places, such as ceiling lights, chandeliers and the like. When attempting to change these light bulbs, a person normally is exposed to some degree of danger when turning the light bulb with their hand. The typical risk involved is a potential fall from a precarious perch utilized by the person in order to reach these high areas. What is needed is a light bulb and corresponding socket that does not require a person to turn a light bulb a number of times in order to facilitate a proper coupling.

The present invention attempts to solve the above mentioned problem by providing a light bulb and corresponding socket that utilizes a magnetic coupling to eliminate the need to rotate a light bulb into a socket.

The use of electrical socket devices is known in the prior art. More specifically, electrical socket devices heretofore devised and utilized for the purpose of improving a coupling with a light bulb are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,156,265 to Rose discloses a lamp socket connected with a magnetic reed switch, for safety purposes, for keeping the socket inoperable unless a load is inserted U.S. Pat. Pat. No. 4,318,159 to Kaisner discloses a magnetic light fixture.

While these devices fulfill their respective, particular objective and requirements, the aforementioned patents do not describe a socket and light bulb assembly utilizing magnetic coupling for simplifying the replacement of light bulbs by eliminating the need to rotate the light bulb in order to remove it from the socket.

In this respect, the socket and light bulb assembly utilizing magnetic coupling according to the present invention substantially departs from the conventional concepts and designs of the prior art, and in doing so provides an apparatus primarily developed for the purpose of simplifying the replacement of light bulbs by eliminating the need to rotate the light bulb in order to remove it from the socket.

Therefore, it can be appreciated that there exists a continuing need for a new and improved socket and light bulb assembly utilizing magnetic coupling which can be used for simplifying the replacement of light bulbs by eliminating the need to rotate the light bulb in order to remove it from the socket. In this regard, the present invention substantially fulfills this need.

SUMMARY OF THE INVENTION

In the view of the foregoing disadvantages inherent in the known types of electrical socket devices now present in the prior art, the present invention provides an improved socket and light bulb assembly utilizing magnetic coupling. As such, the general purpose of the present invention, which will be described subsequently in greater detail, is to provide a new and improved socket and light bulb assembly utilizing magnetic coupling which has all the advantages of the prior art and none of the disadvantages.

To attain this, the present invention essentially comprises a socket portion having a generally cylindrical configuration. The socket portion has a first end and a second end. The first end has a recess extending inwardly thereof. The recess is defined by a smooth interior surface. The recess has a magnetic disk disposed at a bottom thereof. The socket portion has a rod extending outwardly of the magnetic disk. The rod has a free outer end. The rod has a low tension spring disposed thereon. The free outer end has a contact disposed thereon. The socket portion includes wiring in communication with the contact for being coupled with an electrical source. A light bulb portion is provided that is adapted for coupling with the socket portion. The light bulb portion includes an upper light portion and a lower stem portion. The lower stem portion is dimensioned for being received within the recess of the socket portion. The lower stem portion is defined by a smooth exterior surface. The lower stem portion has a retention spring extending laterally therefrom. The lower stem portion has a recess extending upwardly thereof. The recess has a contact disposed therein. The recess receives the rod of the socket portion therein whereby the contact of the rod connects with the contact of the light bulb portion to complete a circuit. A standard socket adapter is provided that is adapted for being coupled with a standard electrical threaded socket and receiving the light bulb portion. The standard socket adapter has external threads and a lower contact for engaging the standard electrical threaded socket. The adapter has a recess extending inwardly thereof. The recess is defined by a smooth interior surface. The recess has a magnetic disk disposed at a bottom thereof. The socket portion:has a rod extending outwardly of the magnetic disk. The rod has a free outer end. The rod has a low tension spring disposed thereon. The free outer end has a contact disposed thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved socket and light bulb assembly utilizing magnetic coupling which has all the advantages of the prior art electrical socket devices and none of the disadvantages.

It is another object of the present invention to provide a new and improved socket and light bulb assembly utilizing magnetic coupling which may be easily and efficiently manufactured and marketed.

It is a further object of the present invention to provide a new and improved socket and light bulb assembly utilizing magnetic coupling which is of durable and reliable construction.

An even further object of the present invention is to provide a new and improved socket and light bulb assembly utilizing magnetic coupling which is susceptible of a low cost of manufacture with regard to both materials and labor, and which accordingly is then susceptible of low prices of sale to the consuming public, thereby making such a socket and light bulb assembly utilizing magnetic coupling economically available to the buying public.

Even still another object of the present invention is to provide a new and improved socket and light bulb assembly utilizing magnetic coupling for simplifying the replacement of light bulbs by eliminating the need to rotate the light bulb in order to remove it from the socket.

Lastly, it is an object of the present invention to provide a new and improved socket and light bulb assembly utilizing magnetic coupling including a socket portion having a generally cylindrical configuration. The socket portion has a first end and a second end. The first end has a recess extending inwardly thereof. The recess is defined by a smooth interior surface. The recess has a magnetic disk disposed at a bottom thereof. The socket portion has a contact disposed thereon. The socket portion includes wiring in communication with the contact for being coupled with an electrical source. A light bulb portion is provided that is adapted for coupling with the socket portion. The light bulb portion includes an upper light portion and a lower stem portion. The lower stem portion is dimensioned for being received within the recess of the socket portion. The lower stem portion is defined by a smooth exterior surface. The lower stem portion has a contact disposed therein whereby the contact of the socket portion connects with the contact of the light bulb portion to complete a circuit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
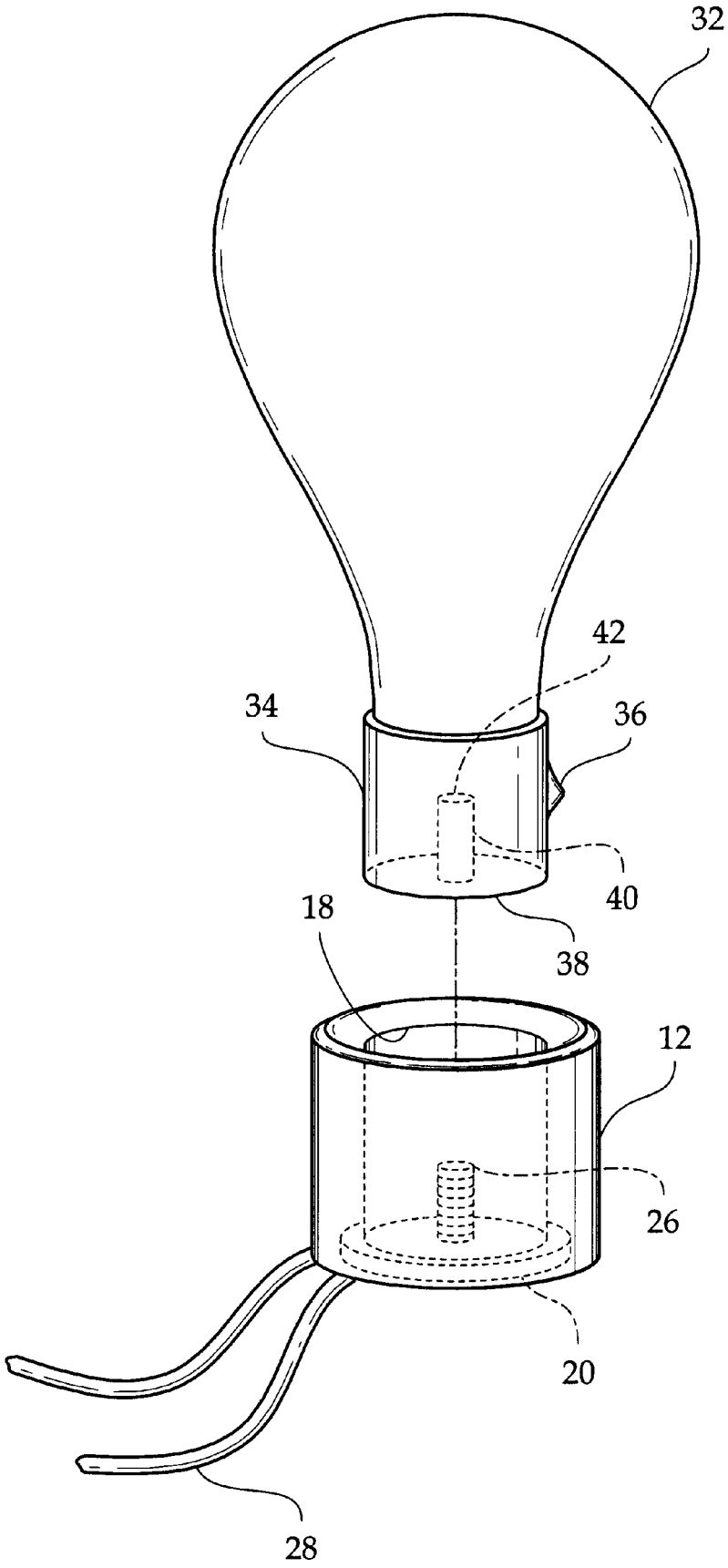
FIG. 1 is a perspective view of the preferred embodiment of the socket and light bulb assembly utilizing magnetic coupling constructed in accordance with the principles of the present invention.
Figure 2:
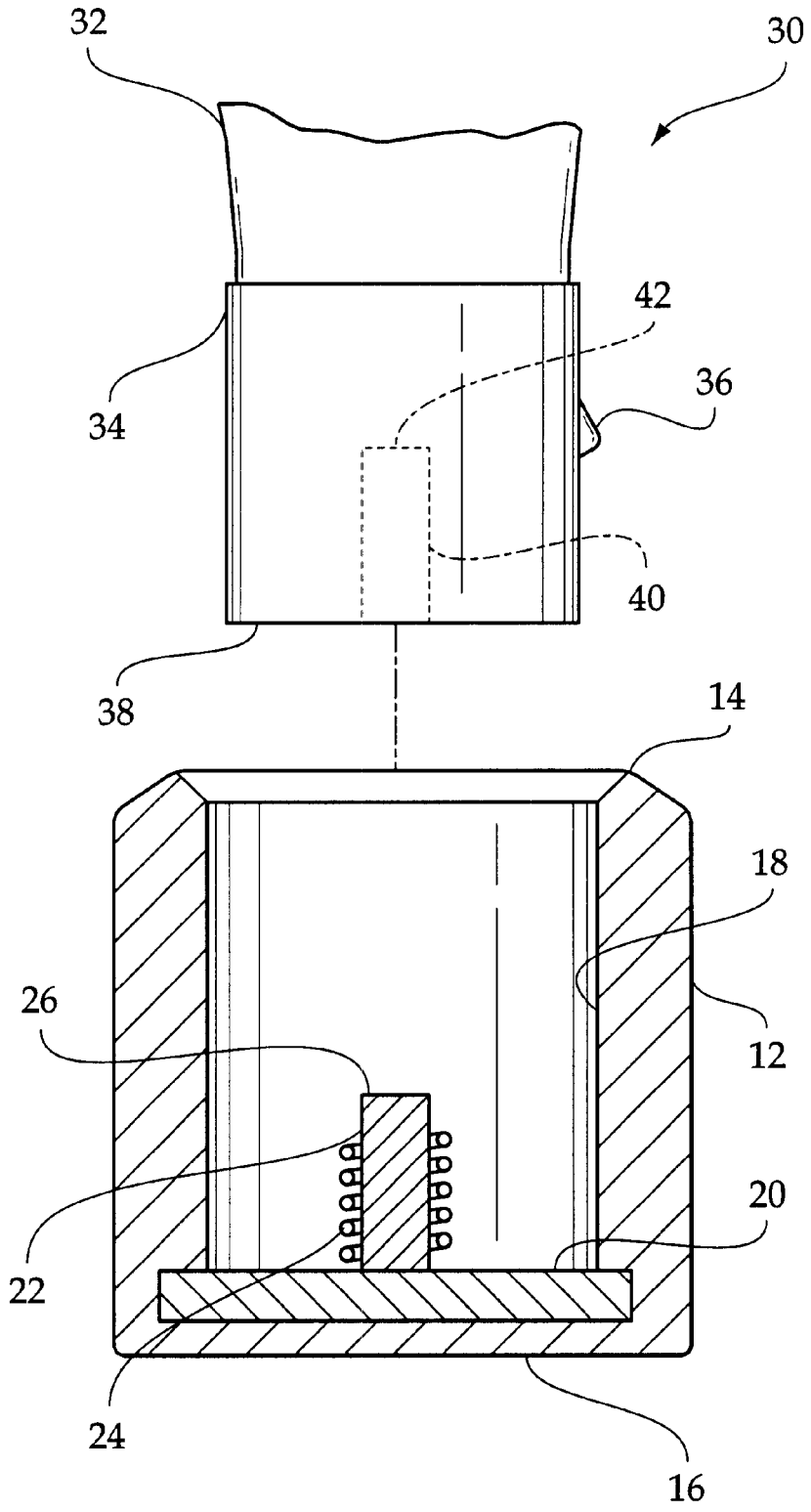
FIG. 2 is a partial front view of the present invention illustrating the coupling of the light bulb with the socket thereof.
Figure 3:
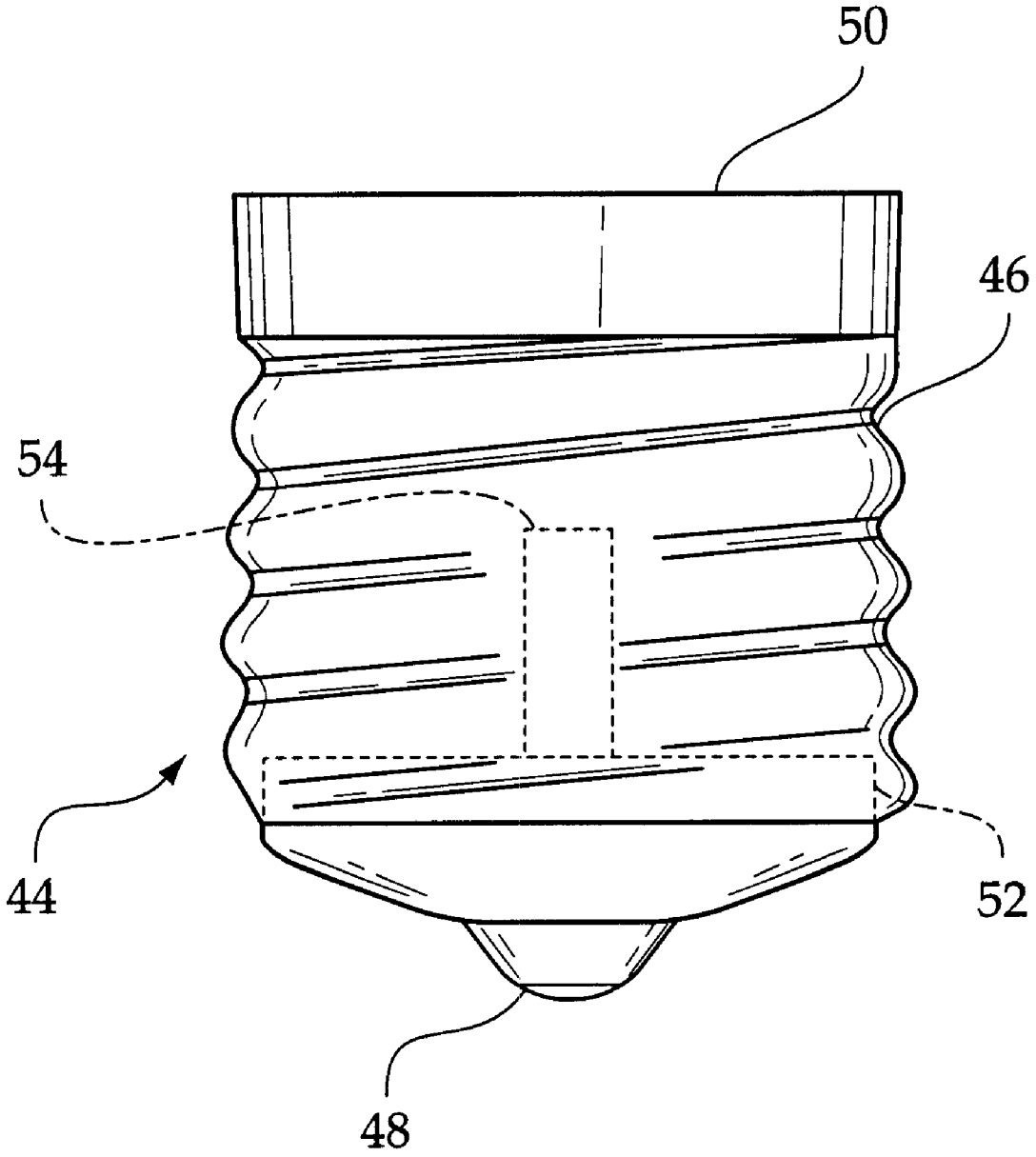
FIG. 3 is a perspective view of the adapter socket of the present invention.

With reference now to the drawings, and in particular, to FIGS. 1 through 3 thereof, the preferred embodiment of the new and improved socket and light bulb assembly utilizing magnetic coupling embodying the principles and concepts of the present invention and generally designated by the reference number 10 will be described.

Specifically, it will be noted in the various figures that the device relates to a socket and light bulb assembly utilizing magnetic coupling for simplifying the replacement of light bulbs by eliminating the need to rotate the light bulb in order to remove it from the socket. In its broadest context, the device consists of a socket portion, a light bulb portion, and a standard socket adapter. Such components are individually configured and correlated with respect to each other so as to attain the desired objective.

The socket portion 12 has a generally cylindrical configuration. The socket portion 12 has a first end 14 and a second end 16. The first end 14 has a recess 18 extending inwardly thereof. The recess 18 is defined by a smooth interior metallic surface. The recess 18 has a magnetic disk 20 disposed at a bottom thereof. The socket portion 12 has a rod 22 extending outwardly of the magnetic disk 20. The rod 22 has a free outer end. The rod 22 has a low tension spring 24 disposed thereon. The free outer end has a contact 26 disposed thereon. The socket portion 12 includes wiring 28 in communication with the contact 26 for being coupled with an electrical source. Note FIGS. 1 and 2.

The light bulb portion 30 is adapted for coupling with the socket portion 12. The light bulb portion 30 includes an upper light portion 32 and a lower stem portion 34. The lower stem portion 34 is dimensioned for being received within the recess 18 of the socket portion 12. The lower stem portion 34 is defined by a smooth exterior surface. The lower stem portion 34 has a retention spring 36 extending laterally therefrom. The retention spring 36 will prevent the light bulb portion 30 from accidentally being disengaged from the socket portion 12. The lower stem portion 34 has a ferromagnetic lower end 38. The metallic lower end 38 will be attracted by the magnetic disk 20 of the socket portion 12. The lower stem portion 34 has a recess 40 extending upwardly thereof. The recess 40 has a contact 42 disposed therein. The recess 40 receives the rod 22 of the socket portion 12 therein whereby the contact 22 of the rod 26 connects with the contact 42 of the light bulb portion 30 to complete a circuit. Note FIGS. 1 and 2.

The standard socket adapter 44 is adapted for being coupled with a standard electrical threaded socket and receiving the light bulb portion 30. Note FIG. 3. The standard socket adapter 44 has external threads 46 and a lower contact 48 for engaging the standard electrical threaded socket. The adapter 44 has a recess 50 extending inwardly thereof. The recess 50 is defined by a smooth interior surface. The recess 50 has a magnetic disk 52 disposed at a bottom thereof. The adapter has a rod 54 extending outwardly of the magnetic disk 52. The rod 54 has a free outer end. The rod 54 has a low tension spring disposed thereon. The free outer end has a contact disposed thereon. The adapter 44 will be screwed into a standard socket to allow the light bulb portion 30 of the present invention to be used in place of standard light bulbs.

As to the manner of usage and operation of the present invention, the same should be apparent from the above description. Accordingly, no further discussion relating to the manner of usage and operation will be provided.

It should be further understood that the principles of the invention may be adapted for use with fluorescent, as well as incandescent light fixtures. In a fluorescent fixture of course, two sockets are employed.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A socket and light bulb assembly utilizing magnetic coupling for simplifying the replacement of light bulbs by eliminating the need to rotate the light bulb in order to remove it from the socket comprising, in combination:

a socket portion having a generally cylindrical configuration, the socket portion having a first end and a second end, the first end having a recess extending inwardly thereof, the recess being defined by a smooth interior metallic surface, the recess having a magnetic disk disposed at a bottom thereof, the socket portion having a rod extending outwardly of the magnetic disk, the rod having a free outer end, the rod having a low tension spring disposed thereon, the free outer end having a contact disposed thereon, the socket portion including wiring in communication with the contact for being coupled with an electrical source;

a light bulb portion adapted for coupling with the socket portion, the light bulb portion including an upper light portion and a lower stem portion, the lower stem portion being dimensioned for being received within the recess of the socket portion, the lower stem portion being defined by a smooth exterior surface, the lower stem portion having a retention spring extending laterally therefrom, the lower stem portion having a metallic lower end, the lower stem portion having a recess extending upwardly thereof, the recess having a contact disposed therein, the recess receiving the rod of the socket portion therein whereby the contact of the rod connects with the contact of the light bulb portion to complete a circuit; and a standard socket adapter adapted for being coupled with a standard electrical threaded socket and receiving the light bulb portion, the standard socket adapter having: external threads and a lower contact for engaging the standard electrical threaded socket, the adapter having a recess extending inwardly thereof, the recess being defined by a smooth interior surface, the recess having a magnetic disk disposed at a bottom: thereof, the socket portion having a rod extending outwardly of the magnetic disk, the rod having a free outer end, the rod having a low tension spring disposed thereon, the free outer end having a contact disposed thereon.

2. A socket and light bulb assembly utilizing magnetic coupling for simplifying the replacement of light bulbs by eliminating the need to rotate the light bulb in order to remove it from the socket comprising, in combination:

a socket portion having a generally cylindrical configuration, the socket portion having a first end and a second end, the first end having a recess extending inwardly thereof, the recess being defined by a smooth interior surface, the recess having a magnetic disk disposed at a bottom thereof, the socket portion having a contact disposed thereon, the socket portion including wiring in communication with the contact for being coupled with an electrical source;

a light bulb portion adapted for coupling with the socket portion, the light bulb portion including an upper light portion and a lower stem portion, the lower stem portion being dimensioned for being received within the recess of the socket portion, the lower stem portion being defined by a smooth exterior surface, the lower stem portion having a metallic lower end, the lower stem portion having a contact, the contact of the socket portion connects with the contact of the light bulb portion to complete a circuit; and a standard socket adapter, adapted for being coupled with a standard electrical socket and receiving the light bulb portion.

3. The socket and light bulb assembly utilizing magnetic coupling as set forth in claim 2, wherein the standard socket adapter has external threads and a lower contact for engaging the standard electrical threaded socket.

4. The socket and light bulb assembly utilizing magnetic coupling as set forth in claim 3, wherein the adapter has a recess extending inwardly thereof, the recess being defined by a smooth interior surface, the recess having a magnetic disk disposed at a bottom thereof.

5. The socket and light bulb assembly utilizing magnetic coupling as set forth in claim 2, wherein the socket portion has a rod extending outwardly of the magnetic disk, the rod having a free outer end, the rod having a low tension spring disposed thereon, the free outer end having the contact disposed thereon, the lower stem portion having a recess extending upwardly thereof, the recess having the contact disposed therein, the recess receiving the rod of the socket portion therein whereby the contact of the rod connects with the contact of the light bulb portion to complete a circuit.

6. The socket and light bulb assembly utilizing magnetic coupling as set forth in claim 2, wherein the lower stem portion has a retention spring extending laterally therefrom.

* * * * *